US011549455B2

(12) United States Patent
Carlson et al.

(10) Patent No.: US 11,549,455 B2
(45) Date of Patent: Jan. 10, 2023

(54) SKIP CYLINDER COMPRESSION BRAKING

(71) Applicants: Tula Technology, Inc., San Jose, CA (US); Cummins Inc., Columbus, IN (US)

(72) Inventors: Steven E. Carlson, Oakland, CA (US); Louis J. Serrano, Los Gatos, CA (US); Mark A. Wilcutts, Berkeley, CA (US); Vijay Srinivasan, Farmington Hills, MI (US)

(73) Assignees: Tula Technology, Inc., San Jose, CA (US); Cummins Inc., Columbus, IN (US)

( * ) Notice: Subject to any disclaimer, the term of this patent is extended or adjusted under 35 U.S.C. 154(b) by 0 days.

(21) Appl. No.: 16/839,651

(22) Filed: Apr. 3, 2020

(65) Prior Publication Data

US 2020/0318566 A1 Oct. 8, 2020

Related U.S. Application Data

(60) Provisional application No. 62/830,763, filed on Apr. 8, 2019, provisional application No. 62/860,591, filed on Jun. 12, 2019.

(51) Int. Cl.

| | |
|---|---|
| ***F02D 41/00*** | (2006.01) |
| ***F02D 17/02*** | (2006.01) |
| ***F02D 41/24*** | (2006.01) |

(52) U.S. Cl.

CPC ..... *F02D 41/0087* (2013.01); *F02D 17/02* (2013.01); *F02D 41/2422* (2013.01);
(Continued)

(58) Field of Classification Search

CPC ..... F02D 41/0087; F02D 41/2422; F02D 41/3058; F02D 41/0007; F02D 41/123;
(Continued)

(56) References Cited

U.S. PATENT DOCUMENTS

| | | | |
|---|---|---|---|
| 3,756,205 | A | 9/1973 | Frost |
| 4,062,334 | A | 12/1977 | Toda et al. |

(Continued)

FOREIGN PATENT DOCUMENTS

| | | |
|---|---|---|
| CN | 87107024 | 8/1988 |
| CN | 1924345 | 3/2007 |

(Continued)

OTHER PUBLICATIONS

International Search Report and Written Opinion dated Jul. 31, 2020 from International Application No. PCT/US2020/026940.

(Continued)

*Primary Examiner* — Phutthiwat Wongwian
*Assistant Examiner* — Sherman D Manley
(74) *Attorney, Agent, or Firm* — Beyer Law Group LLP

(57) ABSTRACT

An internal combustion engine operates so that it delivers zero or negative torque. The engine operates in either a deceleration cylinder cut off (DCCO) mode or skip cylinder compression braking mode. In the skip cylinder compression braking mode, selected working cycles of selected working chambers are operated in a compression release braking mode. Accordingly, individual working chambers are sometimes not fired and sometimes operated in the compression release braking mode while the engine is operating in the skip cylinder compression braking mode.

23 Claims, 6 Drawing Sheets

(52) U.S. Cl.
CPC .... *F02D 2200/101* (2013.01); *F02D 2200/50* (2013.01); *F02D 2200/602* (2013.01); *F02D 2200/702* (2013.01); *F02D 2250/18* (2013.01)

(58) Field of Classification Search
CPC ..... F02D 17/02; F02D 2250/18; F02D 2200/602; F02D 2200/50; F02D 2200/702; F02D 2200/101; F02D 2200/701; F02D 2200/0802; F02D 13/06; F02D 13/04; F02D 29/02
See application file for complete search history.

(56) References Cited

U.S. PATENT DOCUMENTS 4,204,483 A 5/1980 Harada et al.
4,274,382 A 6/1981 Sugasawa et al.
4,276,863 A 7/1981 Sugasawa et al.
4,305,365 A 12/1981 Iizuka et al.
4,434,767 A 3/1984 Kohama et al.
4,489,695 A 12/1984 Kohama et al.
4,494,503 A 1/1985 Danno et al.
4,509,488 A 4/1985 Forster et al.
4,592,315 A 6/1986 Kobayashi et al.
4,903,489 A 2/1990 Ruetz
4,945,869 A 8/1990 Klomp
5,117,790 A 6/1992 Clarke et al.
5,377,631 A 1/1995 Schechter et al.
5,483,941 A 1/1996 Cullen et al.
5,597,371 A 1/1997 Toukura
5,667,029 A 9/1997 Urban et al.
5,669,357 A 9/1997 Denz et al.
5,720,257 A 2/1998 Motose et al.
5,769,054 A 6/1998 Schnaibel et al.
5,975,052 A 11/1999 Moyer
6,158,411 A 12/2000 Morikawa
6,192,857 B1 2/2001 Shimada
6,307,277 B1 * 10/2001 Tamai ..... B60W 10/06 290/40 C
6,376,927 B1 * 4/2002 Tamai ..... B60K 6/383 290/31
6,412,277 B2 7/2002 Hagen et al.
6,532,944 B1 3/2003 Leone et al.
6,553,962 B1 4/2003 Russ et al.
6,615,776 B1 9/2003 Andrian-Werburg
6,619,258 B2 9/2003 McKay et al.
6,619,267 B1 9/2003 Pao
6,625,535 B2 9/2003 Han et al.
6,629,024 B2 9/2003 Tabata
6,718,937 B2 4/2004 Kim
6,735,938 B2 5/2004 Surnilla
6,823,835 B2 11/2004 Dunsworth et al.
6,837,320 B2 1/2005 Wakashiro et al.
6,866,020 B2 3/2005 Allston et al.
6,978,204 B2 12/2005 Surnilla et al.
7,000,602 B2 2/2006 Cullen et al.
7,028,670 B2 4/2006 Doering
7,028,793 B2 4/2006 Hu et al.
7,032,572 B2 4/2006 Bidner et al.
7,032,581 B2 4/2006 Gibson et al.
7,050,900 B2 5/2006 Miller et al.
7,051,693 B2 5/2006 Tetsuno et al.
7,063,062 B2 6/2006 Lewis et al.
7,066,136 B2 6/2006 Ogiso
7,080,625 B2 7/2006 Albertson et al.
7,086,386 B2 8/2006 Doering
7,128,044 B1 10/2006 Doering et al.
7,146,966 B2 12/2006 Nakamura
7,225,782 B2 6/2007 Pallett et al.
7,225,801 B2 6/2007 Pallet et al.
7,249,583 B2 7/2007 Bidner et al.
7,263,959 B2 9/2007 Kataoka et al.
7,275,525 B2 10/2007 Miyasuko et al.
7,308,886 B2 12/2007 Bailes et al.
7,308,959 B2 12/2007 Roberts
7,308,962 B2 12/2007 Sen et al.
7,431,023 B2 7/2008 Kavanaugh et al.
7,426,915 B2 9/2008 Gibson et al.
7,448,983 B2 11/2008 Doering et al.
7,461,621 B2 12/2008 Ota et al.
7,464,674 B2 12/2008 Michelini et al.
7,503,312 B2 3/2009 Surnilla et al.
7,526,375 B2 4/2009 Buslepp et al.
7,530,343 B2 5/2009 Megli
7,566,103 B2 7/2009 Wanner et al.
7,577,511 B1 8/2009 Tripathi et al.
7,621,126 B2 11/2009 Kolmanovsky et al.
7,647,766 B2 1/2010 Surnilla et al.
7,743,752 B2 6/2010 Kerns et al.
7,762,241 B2 7/2010 Childress et al.
7,849,835 B2 12/2010 Tripathi et al.
7,867,134 B2 1/2011 Choi
7,886,715 B2 2/2011 Tripathi et al.
7,900,596 B2 3/2011 Hartmann et al.
7,918,214 B2 4/2011 Kerns et al.
7,930,087 B2 4/2011 Gibson et al.
7,941,994 B2 5/2011 Surnilla et al.
7,954,474 B2 6/2011 Tripathi et al.
8,047,961 B2 11/2011 Jess et al.
8,086,390 B2 12/2011 Whitney et al.
8,099,224 B2 1/2012 Tripathi et al.
8,131,445 B2 3/2012 Tripathi et al.
8,131,447 B2 3/2012 Tripathi et al.
8,136,497 B2 3/2012 Gibson et al.
8,141,533 B2 3/2012 Demura
8,157,035 B2 4/2012 Whitney et al.
8,214,127 B2 7/2012 Whitney
8,215,284 B2 7/2012 Suzuki et al.
8,346,418 B2 1/2013 Heisel et al.
8,353,266 B2 1/2013 White et al.
8,355,860 B2 1/2013 Liu et al.
8,386,150 B2 2/2013 Whitney et al.
8,402,942 B2 3/2013 Tripathi et al.
8,468,988 B2 6/2013 Nishikiori et al.
8,550,055 B2 10/2013 Ferch et al.
8,606,483 B2 12/2013 Krupadanam et al.
8,616,181 B2 12/2013 Sahandiesfanjani et al.
8,667,953 B2 3/2014 Gallon et al.
8,701,628 B2 4/2014 Tripathi et al.
8,707,923 B2 * 4/2014 Vigild ..... F02M 31/13 123/179.21
8,831,861 B2 9/2014 Rammer et al.
8,839,766 B2 9/2014 Serrano et al.
9,086,020 B2 7/2015 Pirjaberi et al.
9,097,200 B2 8/2015 Yamauchi et al.
9,120,478 B2 9/2015 Carlson et al.
9,273,643 B2 3/2016 Carlson et al.
9,328,672 B2 5/2016 Serrano et al.
9,371,813 B2 6/2016 Okamoto et al.
9,387,849 B2 7/2016 Soliman et al.
9,399,964 B2 * 7/2016 Younkins ..... F01L 1/047
9,416,736 B2 8/2016 Bergkoetter et al.
9,512,765 B2 12/2016 Horst et al.
9,567,928 B2 2/2017 Rayl et al.
9,573,594 B2 2/2017 Mitsuyasu
9,650,923 B2 5/2017 Parsels et al.
9,650,971 B2 5/2017 Pirjaberi et al.
9,677,486 B2 6/2017 Kees et al.
9,745,905 B2 8/2017 Pirjaberi et al.
9,759,137 B2 9/2017 Kawaguchi
9,790,867 B2 10/2017 Carlson et al.
9,850,833 B2 12/2017 Miyahara et al.
9,874,166 B2 1/2018 Ervin
10,029,668 B2 7/2018 Aikawa et al.
10,077,726 B2 * 9/2018 Richards ..... F02D 41/0087
10,167,799 B2 1/2019 Serrano et al.
10,170,850 B2 1/2019 Jandt et al.
10,221,786 B2 3/2019 Serrano et al.
10,233,796 B2 3/2019 Shost et al.
10,247,121 B2 4/2019 Shost et al.
10,371,028 B2 * 8/2019 Martin ..... F01N 3/031
10,408,140 B2 9/2019 Yuan et al.
10,494,971 B2 12/2019 Younkins et al.
10,571,366 B2 2/2020 Dudar

(56) References Cited

U.S. PATENT DOCUMENTS

| | | | | |
|---|---|---|---|---|
| 10,704,504 | B1 | 7/2020 | Smith et al. | |
| 10,711,715 | B2 | 7/2020 | Glugla | |
| 10,830,169 | B1 | 11/2020 | Banker et al. | |
| 10,900,425 | B2 | 1/2021 | Yuan et al. | |
| 2008/0041336 | A1* | 2/2008 | Gibson | F02D 41/123 123/322 |
| 2008/0078593 | A1 | 4/2008 | Ortmann et al. | |
| 2010/0050993 | A1 | 3/2010 | Zhao et al. | |
| 2011/0048372 | A1 | 3/2011 | Dibble et al. | |
| 2011/0130938 | A1 | 6/2011 | Seok et al. | |
| 2013/0092127 | A1* | 4/2013 | Pirjaberi | F02D 17/02 123/406.23 |
| 2014/0053804 | A1 | 2/2014 | Rayl et al. | |
| 2015/0260117 | A1* | 9/2015 | Shost | F02D 41/0087 123/481 |
| 2016/0061119 | A1* | 3/2016 | Vosz | F02D 41/0087 123/350 |
| 2016/0146121 | A1* | 5/2016 | Carlson | F01N 11/007 60/276 |
| 2016/0258375 | A1* | 9/2016 | Jammoussi | F02D 41/1454 |
| 2017/0234253 | A1* | 8/2017 | Serrano | F02D 41/126 123/436 |
| 2017/0321617 | A1 | 11/2017 | Kalluri et al. | |
| 2017/0342922 | A1 | 11/2017 | Pirjaberi et al. | |
| 2017/0370308 | A1* | 12/2017 | Hashemi | F02D 13/06 |
| 2018/0134272 | A1 | 5/2018 | Doering et al. | |
| 2018/0172102 | A1 | 6/2018 | Lee et al. | |
| 2018/0334162 | A1* | 11/2018 | Lin | B60W 30/025 |
| 2019/0024594 | A1* | 1/2019 | Shost | F02D 41/0085 |
| 2020/0011257 | A1* | 1/2020 | Stretch | F02D 17/02 |
| 2020/0318565 | A1 | 10/2020 | Srinivasan et al. | |
| 2020/0318566 | A1* | 10/2020 | Carlson | F02D 13/04 |

FOREIGN PATENT DOCUMENTS

| | | |
|---|---|---|
| CN | 102162401 | 8/2011 |
| CN | 10357438 | 9/2016 |
| EP | 1 396 624 | 5/2007 |
| JP | S60228771 | 11/1985 |
| JP | H06193477 | 7/1994 |
| JP | H0868459 | 3/1996 |
| JP | H08105335 | 4/1996 |
| JP | 2002-089307 | 3/2002 |
| JP | 2009-168715 | 7/2009 |
| WO | WO 2010/006311 | 1/2010 |
| WO | WO 2011/085383 | 7/2011 |
| WO | WO 2016/153837 | 9/2016 |
| WO | WO 2017-127219 | 7/2017 |

OTHER PUBLICATIONS

Srinivasan, U.S. Appl. No. 16/839,609, filed Apr. 3, 2020.
Serrano et al., U.S. Appl. No. 17/213,387 entitled "Deceleration Management for Dynamic Skip Fire", filed Mar. 26, 2021.
European Search Report dated Oct. 21, 2022 from International Application No. 22179300.3.

* cited by examiner

SKIP CYLINDER COMPRESSION BRAKING

CROSS-REFERENCE TO RELATED APPLICATIONS

This application claims priority of U.S. Provisional Application Nos. 62/830,763, filed Apr. 8, 2019 and 62/860,591, filed Jun. 12, 2019, both of which are incorporated by reference in their entirety.

FIELD OF THE INVENTION

The present invention relates to methods and systems for operating an internal combustion engine used to power a vehicle in a skip fire manner More specifically, if the engine receives a request for zero or negative torque, the engine can operate in a deceleration cylinder cut-off mode or a skip cylinder compression braking mode, in which some working cycles operate as a compression release brake.

BACKGROUND

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. Some such approaches contemplate varying the effective displacement of the engine. Engine control approaches that vary the effective displacement of an engine can be classified into two types of control, multiple fixed displacements and skip fire. In fixed multiple displacement control some fixed set of cylinders is deactivated under low load conditions; for example, an 8-cylinder engine that can operate on the same 4 cylinders under certain conditions. In contrast, skip fire control operates by sometimes skipping and sometimes firing any given cylinder. In general, skip fire engine control is understood to offer a number of potential advantages, including the potential of significantly improved fuel economy in many applications. Although the concept of skip fire engine control has been around for many years, and its benefits are understood, skip fire engine control has only recently started to be used in commercially available engines.

It is well understood that operating engines tend to be the source of significant noise and vibrations, which are often collectively referred to in the field as NVH (noise, vibration and harshness). In general, a stereotype associated with skip fire engine control is that skip fire operation of an engine will make the engine run significantly rougher, that is with increased NVH, relative to a conventionally operated engine. In many applications such as automotive applications, one of the most significant challenges presented by skip fire engine control is vibration control. Indeed, the inability to satisfactorily address NVH concerns is believed to be one of the primary obstacles that has prevented widespread adoption of skip fire types of engine control.

Prior art U.S. Pat. No. 10,077,726 describes an engine capable of cylinder deactivation. The engine is capable of operating in a number of engine cylinder mode regions where only selected cylinder firing patterns can be activated. The boundaries of the engine cylinder mode regions may be adjusted based on the vehicle mass or vehicle weight. The patent describes making a boundary adjustment based on interpolation between a baseline weight and maximum gross vehicle weight. While this type of adjustment may provide acceptable performance in some cases, it fails to recognize how a change in a vehicle's mass or mass distribution may affect the position and magnitude of vehicle resonances that impact the transfer of engine noise and vibration into the engine cabin. The patent also fails to disclose how to select a cylinder firing pattern among the allowed firing patterns within an engine cylinder mode region. The present application describes improvements over the prior art that provide additional skip fire control features and enhancements that can improve performance in a variety of applications.

Compression release braking (CRB) is a method of opening a cylinder exhaust valve at or near top dead center (TDC) of a compression stroke of a working cycle. Compression release braking is commonly used in heavy trucks to provide engine braking, reducing use and wear of the truck's friction brakes. In the prior art, CRB is typically controlled manually by the truck operator using dashboard or stalk controls, which select fixed sets of cylinders to operate in CRB while the other cylinders operate in a fuel cutoff mode continuing to pumping air through the engine. For example, a 6-cylinder engine may operate with for example 2, 4 or 6 cylinders selected to operate with CRB. The overall level of engine braking is controlled by the operator's selection of transmission gear along with this multi-level choice of the number of CRB cylinders.

While the advantages of CRB are well known, manual determination of the number of CRB operating cylinders may be cumbersome is some situations. It would be desirable if use of CRB could be more automated so an appropriate level of engine braking may be determined automatically without driver intervention. It would also be desirable to deactivate cylinders that are not operating in CRB mode to reduce the pumping of air through the engine.

SUMMARY

A method of operating an internal combustion engine having a plurality of working chambers mounted to a vehicle is described. The engine receives a request for zero or negative torque. A decision is made whether it is appropriate to have the internal combustion engine rotate without firing any working cycles. If operation without firing any working cycles is appropriate, the internal combustion engine operates in a deceleration cylinder cut off mode or a skip cylinder braking mode depending on the magnitude of the torque request. In the skip cylinder braking mode, selected working cycles of selected working chambers are operated in a compression release braking mode.

In another aspect, an engine controller for an internal combustion engine having a plurality of working chambers mounted to a vehicle is described. An operational skip fire profile module is arranged to determine whether it is appropriate to have the internal combustion engine rotate without firing any working cycles. If it is determined that operation without firing any working cycles is appropriate, the operational skip fire profile module directs the internal combustion engine to operate in a deceleration cylinder cut off mode or a skip cylinder braking mode depending on a magnitude of a torque request. In the skip cylinder braking mode, selected working cycles of selected working chambers are operated in a compression release braking mode.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

The present invention relates to a system for operating an internal combustion engine in a skip fire manner to provide motive power to a platform, such as a vehicle, tractor trailer, locomotive, boat, or aircraft. More specifically, various implementations of the present invention take platform weight into account to help determine a suitable skip fire firing frequency, firing fraction, firing pattern, or firing sequence. In some embodiments, powertrain slip may also be adjusted based on vehicle weight. Use of the invention described herein may improve fuel economy when the platform is loaded heavily with occupants or cargo. For compression-ignition engines, use of the invention may reduce $NO_x$ and soot emissions in the engine exhaust. The invention generally results in fuel economy improvements and/or engine emission reductions in a platform operating with different cargo and occupant loads. Application of the invention may be especially useful in heavy duty/freight truck applications where the laden weight can be significantly higher (twice or more) than the unladen weight.

Figure 1:
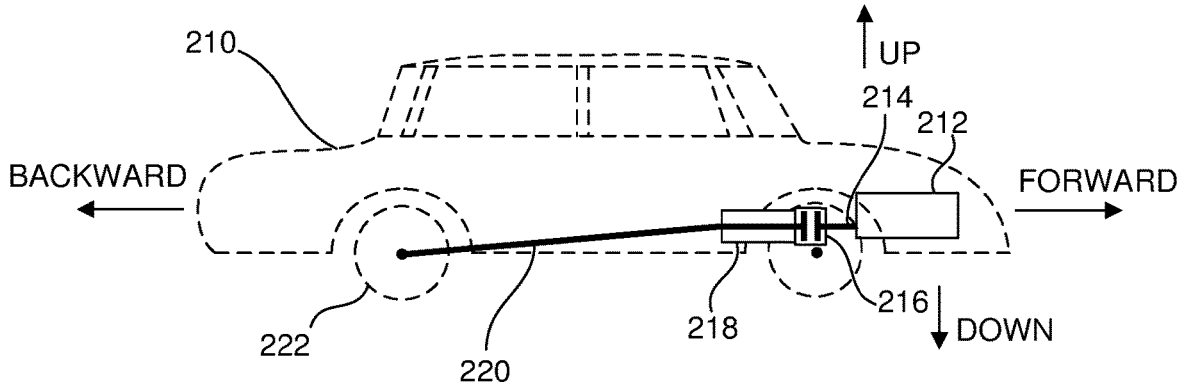
FIG. 1 is a schematic diagram illustrating a powertrain of an exemplary passenger vehicle.

An internal combustion engine may be used as a power source to move a platform to which an internal combustion engine is mounted. FIG. 1 schematically illustrates such a system. FIG. 1 shows a cross-sectional schematic view of an unoccupied passenger vehicle 210. The vehicle 210 has an engine 212 that provides motive power to drive the vehicle 210 forward or backward as desired. Power from the engine 212 is transferred via a crankshaft 214 to a disengagement element 216. The disengagement element 216 may be a clutch, dual clutch, torque converter, or any element that allows the engine 212 to rotate freely from a drive wheel 222. The input and output of the disengagement element 216 may thus rotate at different speeds and have a variable amount of slip between them. The output of the disengagement element 216 is connected to a transmission 218 that has an adjustable rotation speed ratio between its input and output shafts. The transmission 218 may have a fixed number of gears that allows several fixed rotation speed ratios between the input and output shafts or it may be a continuously variable transmission where the ratio between the input and output shafts can be controlled continuously. The output shaft of the transmission may be connected to a driveline 220, which allows transfer of power from the transmission 218 to the drive wheel 222. Various elements in the powertrain, such as a differential, have been omitted for clarity. The vehicle 210 shown in FIG. 1 is a passenger sedan having a longitudinally mounted engine with rear wheel drive. The invention applies equally to front wheel drive vehicles, vehicles with transversely mounted engines, and four (or more) wheel drive vehicles. The invention also applies equally to vehicles with unibody construction (body panels integrated with frame) and vehicles with a body-on-frame construction (body panels mounted to frame). These different types of vehicle constructions can have different NVH characteristics but use of the invention described herein is not limited to the particular NVH characteristics of a vehicle.

The invention described herein is broadly applicable to many types of motorized vehicles powered by an internal combustion engine that operate on roads or unimproved ground, such as sport utility vehicles, pick-up trucks, delivery vans, tractors, etc. The invention is also applicable to locomotives that operate on rails, ships that operate on water, or aircraft that fly in the air. The invention is applicable in any situation where an internal combustion engine supplies motive power to move a platform and the platform's characteristics, such as weight, weight distribution, towed load, etc. may differ at different times of operation.

The internal combustion engine may be a 4-stroke, internal combustion engines with pistons having reciprocating motion within a cylinder. A working cycle consists of a first, intake stroke, a second, compression stroke, a third, expansion, and a fourth, exhaust stroke. The stroke sequence is then repeated in a subsequent working cycle. For fired cylinders, the expansion stroke generates power from combusting fuel trapped within the enclosed volume defined by the piston, cylinder, and cylinder head. For skipped cylinders, no combustion occurs during the expansion stroke. A working cycle is deactivated if the intake or exhaust valve remain closed throughout the working cycle so that no air is pumped through the engine. As described below, a skipped working cycle may generally be deactivated, but there may be circumstances where skipped working cycles pump air through the engine. For a 4-stroke engine, an engine cycle represents two complete revolutions of the engine's crankshaft.

In vehicle applications, torque generated by the engine is transmitted to one or more of the vehicle's wheels. During operation of a motor vehicle, a driver in the vehicle cabin, or an autonomous control system, demands a wide range of engine torque levels and engine speeds to accommodate varying driving conditions. Most vehicles in operation today operate all engine working chambers or cylinders at a substantially equal load level to accommodate these variable torque requests. That is the load on each cylinder in the engine is approximately constant at any given time, but the cylinder load goes up and down to meet the varying torque request.

For naturally aspirated spark-ignition engines, working chamber load level is adjusted primarily through use of throttling air flow into the engine. Spark-ignition engines generally operate with a stoichiometric air/fuel ratio, so adjustment of the amount of inducted air with the throttle also results in a concomitant adjustment in the amount of injected fuel. Operation with a throttle is inefficient, since the working chambers are often operating far from maximum fuel efficiency conditions and throttling leads to pumping losses. Fuel efficiency can be significantly improved by operating the engine in a skip fire manner in which some working chambers are operating at or near an optimum fuel efficiency condition and the remaining working chambers are deactivated.

For compression-ignition engines, working chamber load level is adjusted primarily through use of adjusting an injected fuel mass into the working chamber. Compression-ignition engines can operate over a broad range of air/fuel ratios with relatively high efficiency; however, adjusting the working level load by adjustment of the injected fuel mass makes exhaust gas temperature control difficult. Also, excessively lean or rich air/fuel ratios can result in high levels of noxious combustion products in the exhaust gases, making clean up by an aftertreatment system difficult. Control over the air/fuel ratio and exhaust gas temperature can be significantly improved by operating the engine in a skip fire manner in which some working chambers are operating at or near an optimum combustion condition and the remaining working chambers are deactivated.

In general, skip fire engine control contemplates selectively skipping the firing of certain cylinders during selected firing opportunities. Thus, for example, a particular cylinder may be fired during one firing opportunity and then may be skipped during the next firing opportunity and then selectively skipped or fired during the next. This is contrasted with conventional variable displacement engine operation in which a fixed set of the cylinders are deactivated during certain low-load operating conditions. From an engine cycle perspective, skip fire control may have different sets of cylinders fired during sequential engine cycles to generate the same average torque, whereas conventional variable displacement operation fires the same set of cylinders.

One challenge with skip fire engine control is reducing noise, vibration and harshness (NVH) to an acceptable level. Generally, the acceptable NVH level is determined by providing a suitable comfort level for vehicle occupants. In the case of an unoccupied vehicle, the acceptable NVH level may be set by an acceptable level of noise emission into the environment or avoiding mechanical damage to powertrain elements. The noise and vibration produced by the engine can be transmitted to occupants in the vehicle cabin through a variety of paths. Some of these paths, for example the powertrain, can modify the amplitude of the various frequency components present in the engine noise and vibration signature. Specifically, lower transmission gear ratios tend to amplify vibrations, since the transmission is increasing the torque and the torque variation at the wheels. Engine noise and vibration can also excite various vehicle resonances, which can then couple into the vehicle cabin. Adding passengers and cargo to a vehicle increases the inertia of its body structure. For rigid body motion, the acceleration is inversely proportional to the inertia of the structure. This means that, at low frequencies (sometimes excited by skip fire operation), all other things being equal, a heavier vehicle body would have less vibration than a lighter vehicle body for the same excitation forces.

Some noise and vibration frequencies can be particularly annoying for vehicle occupants. In particular, low frequency, repeating patterns (e.g., frequency components in the range of 0.2 to 8 Hz) tend to generate undesirable vibrations perceived by vehicle occupants. The higher order harmonics of these patterns can cause noise in the passenger cabin. In particular, a frequency typically between 25 and 100 Hz may resonate within the vehicle cabin, the so called "boom" frequency. Commercially viable skip fire engine control requires operating at an acceptable NVH level while simultaneously delivering the desired or requested engine torque output and achieving fuel efficiency improvements or other gains.

A vehicle's NVH level varies with the vehicle weight, engine speed, firing fraction, and transmission gear. For example, consider an engine controller that selects a particular firing fraction that indicates a percentage of firings necessary to deliver a desired torque at a particular engine speed and gear. Based on the firing fraction, the engine controller generates a firing pattern to operate the working chambers of the engine in a skip fire manner. As is well known by those familiar with the art, at a given engine speed an engine that runs smoothly with some firing patterns may generate undesirable acoustic or vibration effects with other firing patterns. Likewise, a given firing pattern may provide acceptable NVH at one engine speed, but the same pattern may produce unacceptable NVH at other engine speeds. Engine induced noise and vibration is also affected by the cylinder load or working chamber output as described in U.S. Pat. No. 10,247,121, which is incorporated herein by reference in its entirety for all purposes. If less air and/or fuel is delivered to a cylinder, the firing of the cylinder will generate less output, as well as less noise and vibration. As a result, if the cylinder output is reduced, some firing patterns that were unusable due to their unacceptable NVH level at a high cylinder load may become usable at a low cylinder load. Similarly, if the vehicle weight changes, either due to an increased number of vehicle occupants or the vehicle carrying a cargo load, the NVH characteristics of the vehicle will change. Also, items externally attached to the vehicle, such as items in a roof rack or items in a towed trailer, may impact a vehicle's NVH characteristics. This is particularly true for tractor trailers, where the weight of the towed trailer can exceed the weight of the towing tractor. For vehicles towing a trailer, vehicle weight may refer to the combined weight of both the towing tractor and towed trailer. Obviously, in some situations the tractor operates without the trailer attached. The NVH characteristics of the tractor alone may differ from that of the tractor pulling an empty trailer.

Figure 2:
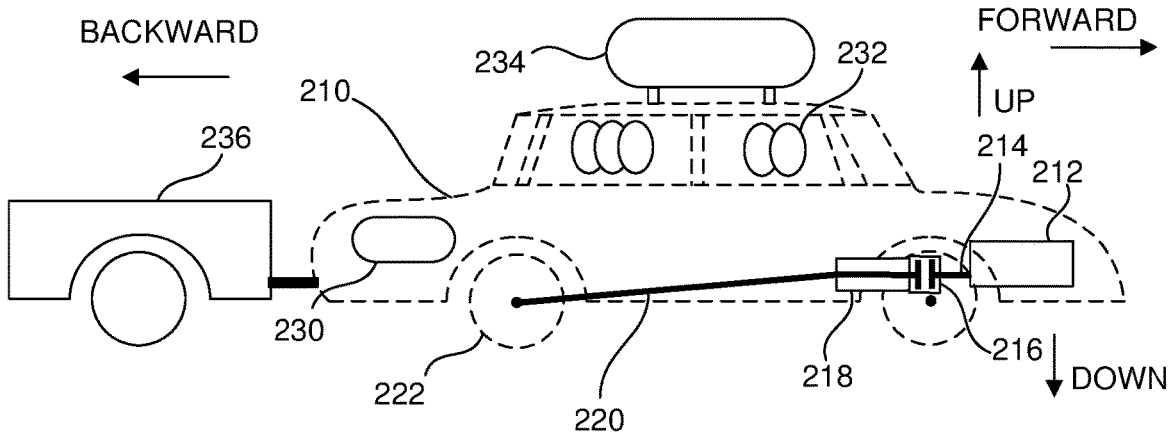
FIG. 2 is a schematic diagram illustrating an exemplary passenger vehicle loaded with vehicle occupants and cargo.

FIG. 2 illustrates the passenger vehicle 210 shown in FIG. 1 in a fully loaded condition. The vehicle 210 may have a plurality of vehicle occupants 232 (5 shown), be towing a trailer 236, may have cargo 234 in a roof rack, and may have cargo 230 in a trunk. These additional elements either in or attached to the vehicle 210 can influence the vehicle's NVH characteristics and alter a set of allowable powertrain parameters, such as firing fraction or density and torque converter slip. For example, an empty passenger vehicle may have a curb weight of approximately 3,000 lbs. If the vehicle is fully loaded with occupants and cargo, the vehicle weight could increase to, for example, 4,500 lbs. This exemplary 50% increase in the vehicle weight may impact how engine generated NVH is transmitted to the vehicle occupants.

Figure 3:
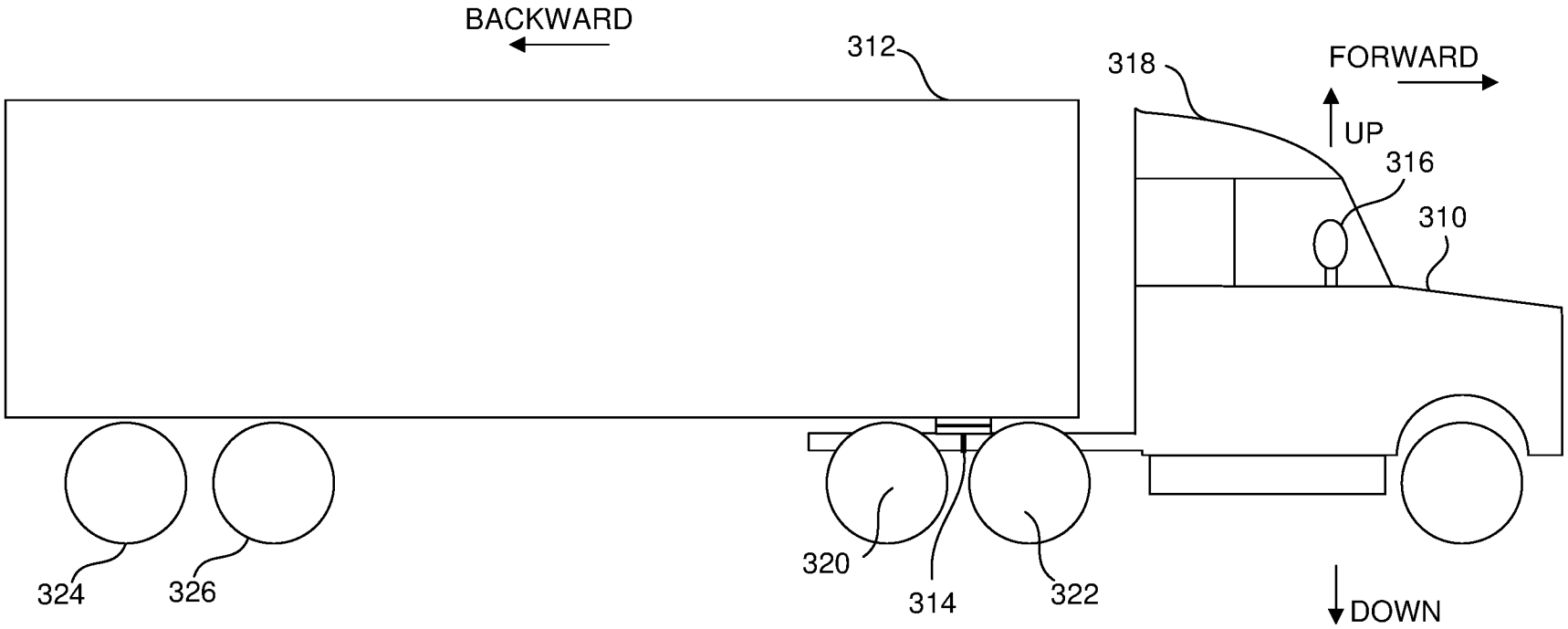
FIG. 3 is a schematic diagram illustrating an exemplary tractor trailer combination.

The change in vehicle weight may be even more dramatic for vehicles such as, pick-up trucks, delivery trucks or tractor trailer combinations. FIG. 3 depicts an exemplary tractor trailer combination. The engine and powertrain elements may all be located in the tractor unit 310 where a driver 316 may be seated. The tractor unit 310 may have a faring 318 to reduce aerodynamic drag. The trailer 312 may have a loaded weight three or more times that of the tractor unit 310. The trailer 312 is often connected to the tractor unit 310 through a fifth wheel coupling 314. In this type of coupling, the tractor unit 310 has an upward facing planar surface with a central opening into which a downward facing kingpin of the trailer 312 is inserted. The trailer 312 has a mating downward facing planar surface which rests on the upward facing planar surface of the tractor unit. These planar surfaces can rotate with respect to each other so that the trailer 312 can easily follow behind the tractor unit 310 through turns. The planar contact surfaces between the tractor unit 310 and trailer 312 allow a substantial fraction of the trailer weight to be borne by the rear wheels 320 and 322 of the tractor unit 310. The remainder of the weight of the trailer 312 is borne by trailer rear wheels 324 and 326.

Figure 4:
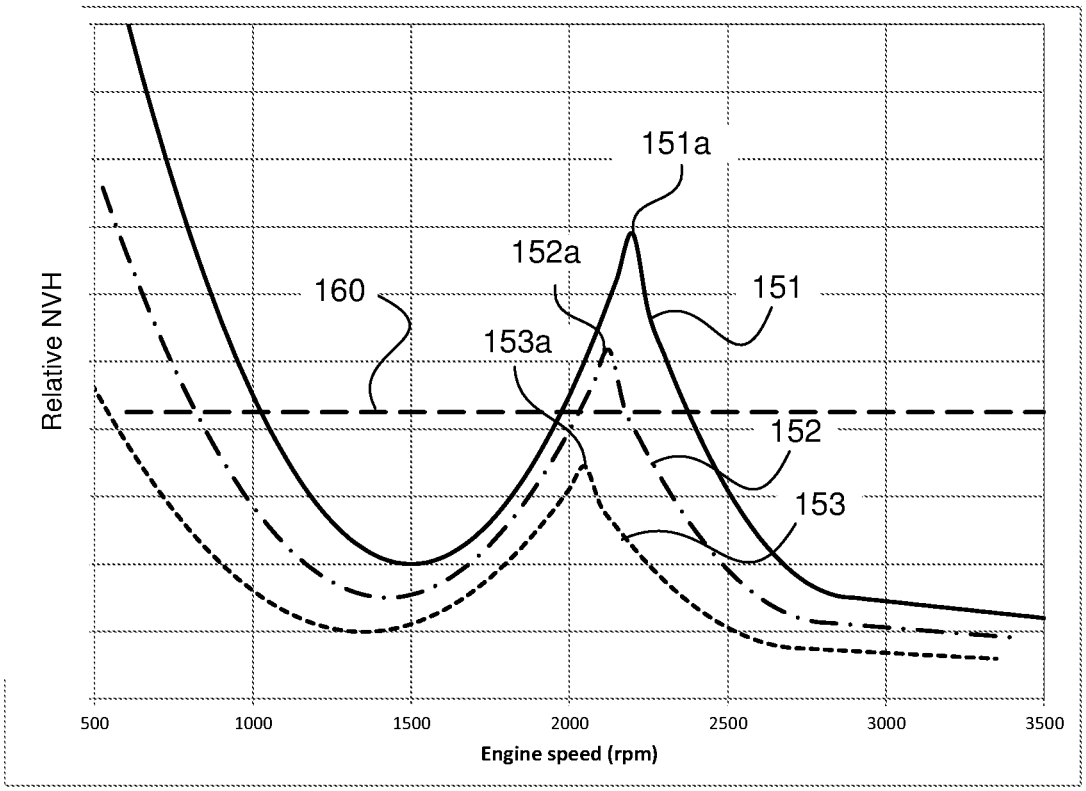
FIG. 4 is an exemplary plot of NVH versus engine speed for a fixed firing fraction, cylinder load, and transmission gear for various vehicle weights.

The impact of changing a vehicle's weight is depicted graphically in FIG. 4, which shows an exemplary plot of NVH versus engine speed for a selected firing fraction and various vehicle weights for a fixed transmission gear ratio and cylinder load. FIG. 4 shows a set of three curves, 151, 152 and 153, corresponding to different values of vehicle weight. Curve 151 corresponds to the minimum vehicle weight, while curves 152 and 153 correspond to successively higher vehicle weights. As shown in FIG. 4 higher vehicle weights produce lower NVH, but the general shape of the NVH curve is essentially similar for any fixed firing fraction, cylinder load, and transmission gear ratio. In general, NVH is higher at low engine speeds because low engine speeds tend to generate vibration in the 0.2 to 8 Hz frequency range, which is particularly unpleasant to vehicle occupants. In addition to high NVH at low engine speeds, one or more resonances 151*a*, 152*a*, 153*a* in the NVH signature may be present at higher engine speeds. These peaks may correspond to the excitation of the cabin boom frequency or other resonances within the vehicle. The location of the resonance peaks associated with each curve 151*a*, 152*a*, and 153*a*, may tend to shift to lower engine speeds as the vehicle mass increases as depicted in FIG. 4; however, depending on the nature of the resonance, the resonant frequencies 151*a*, 152*a*, and 153*a* may all occur at essentially the same frequency in some cases.

Also shown in FIG. 4 is an acceptable NVH limit 160. This limit is shown as having a single, constant value for all engine speeds and driving conditions; however, as described below this need not be the case. In this example, the operating region below the NVH limit 160 represents a region of acceptable operating points from an NVH perspective, while regions above the NVH limit 160 are excluded operating points. Inspection of FIG. 4 indicates that for the lightest vehicle weight, corresponding to curve 151, operation at engine speeds above approximately 1000 rpm results in acceptable NVH characteristics, except for a band around resonance 151*a* where engine speeds in the range of approximately 1950 to 2350 rpm result in unacceptable NVH and are thus excluded operating points. For the intermediate vehicle weight curve 152, operation is allowed at engine speeds above approximately 800 rpm except for a band between approximately 2050 to 2200 rpm. For the heaviest vehicle weight shown, curve 153, operation is allowed at all engine speeds above approximately 550 rpm. Even though curve 153 displays the resonance 153*a*, the maximum NVH at the resonant frequency is still below the allowable limit 160. In general, results similar to that shown in FIG. 4 may be obtained for each firing fraction, cylinder load, and transmission gear ratio. The curves may display multiple resonances at varying engine speeds having different NVH values, but all firing fractions, cylinder loads, and transmission gear ratios will display qualitatively similar curves. Note that in a conventionally controlled engine, i.e. without skip fire where all cylinders operate at substantially the same load, the family of curves obtained corresponds to the case of a firing fraction equal to one.

The present application describes various engine controller implementations that take into account vehicle weight or load to provide fuel efficient, low emissions, operation with acceptable NVH characteristics. Generally, the engine controller is arranged to avoid or select particular firing frequencies, firing fractions, firing patterns or firing sequences, depending on the vehicle weight. The weight distribution may also be considered, such as the weight in a tractor relative to the weight in a trailer or cargo located in the trunk of a vehicle relative to occupants riding in the cabin. In some embodiments, slip in a powertrain disengagement element, such as a torque converter may also be adjusted based on vehicle weight or the presence or absence of a towed trailer.

For a skip fire controlled engine, there is a firing fraction or firing density at every engine speed and load condition which has optimal combustion characteristics, but does not necessarily have acceptable NVH characteristics. For a spark ignition engine, optimal combustion characteristics may correspond to combustion characteristics that provide for optimal fuel efficiency. For a compression ignition engine, optimal combustion characteristics may correspond to an air/fuel ratio which minimizes generation of noxious constituents in the exhaust stream and provides a suitable exhaust gas temperature for aftertreatment systems. At some engine speeds and cylinder loads there are some firing fractions, optimal for combustion characteristics, that exhibit unacceptable NVH in an empty or lightly loaded vehicle. These firing fractions may result in an acceptable NVH level if operating in a more heavily loaded vehicle. Improvements in fuel economy and/or vehicle emissions may be realized by using these formerly excluded firing fractions.

The engine generated NVH permitted for any particular vehicle may vary in accordance with the manufacturer's specifications. Generally, a vehicle is calibrated on a smooth test track with a baseline vehicle weight indicative of a lightly loaded vehicle. Current techniques for calibration of acceptable firing fractions in skip fire operation do not consider vehicle weight or inertial load variations. As a result, skip fire operation is limited by constraints set for a lightly loaded vehicle. These test conditions are often far different than real world driving conditions. For a skip fire controlled engine, this calibration procedure can unnecessarily limit the allowable operational firing fractions and thus reduce potential gains from skip fire operation.

The vibration response of a vehicle depends upon, among other things, the vehicle's mass. Given the same excitation, a more massive body will experience less vibrational acceleration in the low frequency range (vehicle rigid body motion) as depicted graphically in FIG. 4. This allows engine operation at more firing fractions at higher loads without unacceptable levels of vibration compared to when the vehicle is unloaded or lightly loaded. The potential calibration difference due to this effect could be especially large in heavy duty/freight truck applications where the weight differences between loaded and unloaded conditions can be large.

Figure 5:
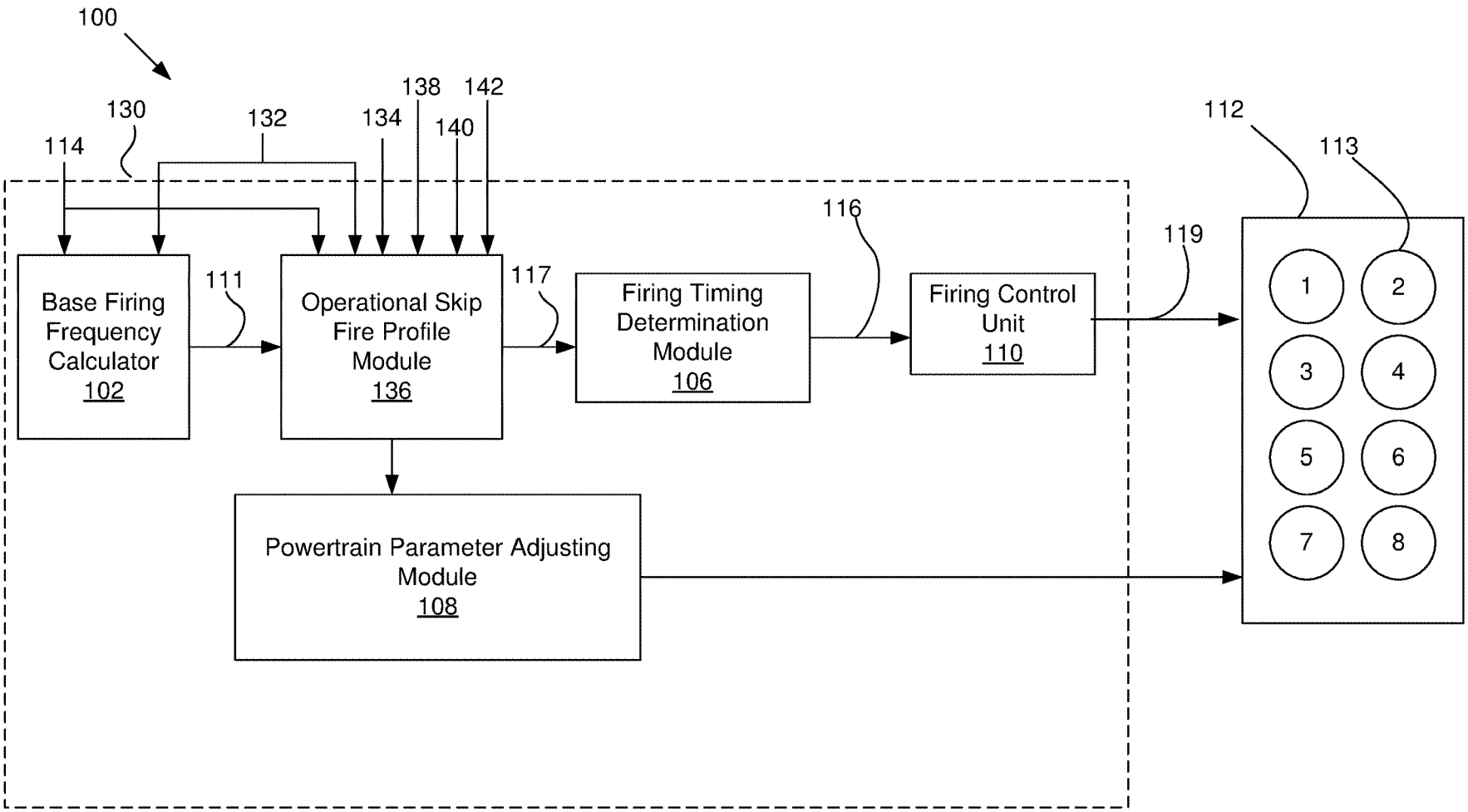
FIG. 5 is a block diagram illustrating an engine controller according to a particular embodiment of the present invention.

Referring to FIG. 5, an engine 100 according to a particular embodiment of the present invention will be described. The engine 100 consists of an engine controller 130 and the working chambers 113 of the engine 112. The engine 112 depicted in FIG. 5 has eight working chambers 113 arranged in two banks. This number of working chamber and working chamber arrangement is exemplary only and engines with any number of working chambers in any arrangement (i.e. in-line, V, opposed) may be used with this invention. The engine controller 130 receives an input signal 114 representative of the desired engine output. The input signal 114 may be treated as a request for a desired engine output or torque. The signal 114 may be received or derived from an accelerator pedal position sensor (APP) or other suitable sources, such as a cruise controller, a torque calculator, an autonomous vehicle controller, etc. An optional preprocessor may modify the accelerator pedal signal prior to delivery to the engine controller 130. However, it should be appreciated that in other implementations, the accelerator pedal position sensor may communicate directly with the engine controller 130. The engine controller 130 may include a base firing frequency calculator 102, an operational skip fire profile module 136, a powertrain parameter adjustment module 108, a firing timing determination module 106, and a firing control unit 110. The engine controller 130 is arranged to operate working chambers of the engine 112 in a skip fire manner. In some embodiments, the engine controller may receive a signal for negative torque from depression of a brake pedal by a driver or by some automated braking system.

The base firing frequency calculator 102 receives input signal 114 (and when present other suitable inputs) and engine speed 132 and is arranged to determine a base firing frequency or firing fraction 111 that would be appropriate to deliver the desired output. The base firing frequency 111 is the firing frequency that delivers the requested torque with a cylinder load that corresponds to optimal or near optimal combustion conditions.

The base firing frequency 111 may be input into an operational skip fire profile module 136. The operational skip fire profile is determined based at least in part on the engine speed 132, a transmission gear 134, a vehicle weight 138, a torque converter slip 140 (if any) and other factors 142, which are all inputs to the operational skip fire profile module 136. The other factors 142 may include, but are not limited to road conditions, driver settings, accelerator pedal position, background cabin noise and vibration, ambient temperature, and the rate of change of the accelerator pedal position. As described in U.S. Pat. No. 9,739,212, which is incorporated herein by reference in its entirety for all purposes, some of these factors may influence what is perceived as an acceptable level of NVH. For example, road noise, use of an entertainment system, or other background noise and vibration, can mask engine generated NVH allowing an increase in the acceptable level of engine generated NVH.

The vehicle weight 138 used as an input into the operational skip fire profile module 136 may be a numerical value indicating the vehicle weight in pounds, kilograms or some other units. Alternatively, the vehicle weight may be converted into a smaller range of numbers denoting a level of loading or may be expressed as a percentage of maximum load. In an exemplary simple embodiment, vehicle weight signal 138 may be a variable denoted with three different states (1, 2, 3) corresponding to light loading, medium loading, and heavy loading as defined by a range of values for weight.

The input signal 114 may also serve as an input to the operational skip fire profile module 136. The operational skip fire profile module 136 determines an operational skip fire profile. The operational skip fire profile includes both an operational firing fraction ($FF_{op}$) and a factor indicative of working chamber output, such as cylinder torque fraction, CTF, which indicates an actual cylinder load relative to a maximum cylinder load or some other reference cylinder load. Other indicators of cylinder load may be used in place of cylinder torque fraction, such as brake torque, cylinder load, net mean effective pressure, air per cylinder (APC), mass air charge (MAC), injected fuel mass, or any other parameter that is related to working chamber output. In various embodiments, the determination of the operational skip fire profile is based on various operating parameters, including but not limited to engine speed, transmission gear, vehicle weight, and torque request.

The operational skip fire profile module 136 takes into account multiple possible working chamber output levels when determining a suitable firing fraction. There are a wide variety of ways in which the operational skip fire profile module 136 can take into account different possible working chamber output levels. In some embodiments, for example, the operational skip fire profile module 136 references one or more lookup tables. The lookup tables may contain entries that indicate allowable engine speeds, cylinder loads and/or other engine parameters for particular firing fractions or frequencies, cylinder loads, gear ratios, and vehicle weights. There may be a discrete set of tables for discrete levels of vehicle loading (e.g. a different set of look-up tables for each 100 pound increase in weight). There may be three discrete set of tables corresponding to a lightly loaded, intermediately loaded, or heavily loaded vehicle.

One or more possible skip fire profiles are evaluated using the lookup tables. Each skip fire profile produces a desired engine torque via some combination of firing frequency and cylinder load. Some of these skip fire profiles will produce unacceptable NVH over certain engine speed ranges, gear settings and vehicle weights and will be excluded from consideration as the operational skip fire profile. Among the remaining skip fire profiles, the operational skip fire module 136 may advantageously select the skip fire profile having the combustion conditions as close as possible to optimal combustion conditions as the operational skip fire profile. Alternatively, the operational skip fire module 136 may use alternative criteria for making the determination of the operational skip fire profile.

In the illustrated embodiment shown in FIG. 5, a powertrain parameter adjusting module 108 is provided that cooperates with the operational skip fire profile module 136. The powertrain parameter adjusting module 108 directs the engine 112 to operate with powertrain parameters selected to ensure that the actual engine output substantially equals the requested engine output at the operational firing fraction. For example, if the operational skip fire profile module 136 determines that a higher firing fraction may be used but would require use of a lower working chamber output level or fuel charge, the powertrain parameter adjusting module 108 would determine that a suitable, lower amount of fuel is delivered to the fired working chambers. The powertrain parameter adjusting module 108 may be responsible for setting any suitable engine setting (e.g., mass air charge, spark timing (in spark ignition engines engines), cam timing, valve lift and timing, exhaust gas recirculation flow, boost conditions (in turbocharged or supercharged engines), throttle position, etc.) to help ensure that the actual engine output matches the requested engine output. The powertrain parameter adjusting module 108 may also control the amount of powertrain slip.

The firing timing determination module 106 receives the operational firing fraction 117 from the operational skip fire profile module 136 and is arranged to issue a sequence of firing commands that cause the engine to deliver the percentage of firings dictated by an operational firing fraction 117. The sequence of firing commands (sometimes referred to as a drive pulse signal 116) outputted by the firing timing determining module 106 are passed to the firing control unit 110 which orchestrates the actual firings through firing signals 119 directed to the engine working chambers 112.

An advantage of various embodiments of the present invention is that they consider vehicle weight in determining an acceptable firing fraction. That is, they do not necessarily assume that the vehicle is in a lightly loaded condition. In some cases, a firing fraction or firing frequency that would be unacceptable with a lightly loaded vehicle may be acceptable for a heavily loaded vehicle. For example referring to the firing fraction depicted in FIG. 4, it would be unacceptable from an NVH perspective to operate a lightly loaded vehicle (represented by curve 151) at 2100 rpm while operation of a heavily loaded vehicle (curve 153) at that speed is acceptable. Utilization of this invention allows access to more firing fractions which generally enables operation at firing fractions that are closer to the base firing frequency, which results in combustion conditions closer to optimal.

It should be appreciated that the engine controller 130 can determine the operational firing fraction 117 in a number of methods including one or more look-up tables. The format and structure of the data in the look-up tables, the number of entries, the inputs to the lookup table, the number of lookup tables and the values in the lookup table can, of course, be modified to suit the needs of different applications. Generally, the data from the aforementioned tables can be stored in or involve any suitable mechanism, data structure, software, hardware, algorithm or lookup table that indicates or represents usage constraints for particular types of firing-related operations, characteristics or firing fractions. For example, some lookup table structures may determine a firing fraction based on a set of input variables. Alternatively, some lookup table structures may determine a maximum cylinder load based on a different set of input variables. Other types of lookup table data structures may be used.

In particular, in some embodiments an operational skip fire profile may be determined without first determining a base firing frequency. In this case, a number of candidate skip fire profiles may be considered by the operational skip fire profile module 136 that deliver the requested torque. The operational skip fire profile module 136 may then select from these candidate skip fire profiles based on multiple criteria; including, but not limited to, NVH and combustion characteristics.

In additional embodiments of the present invention, multiple levels of acceptable NVH may be used. This effectively changes the height of the acceptable NVH criteria line 160 in FIG. 4. More restrictive NVH criteria would result in a lower position for line 160 and less restrictive NVH criteria would result in a higher position for line 160.

Any and all of the described operations may be arranged to refresh their determinations/calculations very rapidly. In some preferred embodiments, these determinations/calculations are refreshed on a firing opportunity by firing opportunity basis although, that is not a requirement. Skip fire control that makes firing decisions on a firing opportunity by firing basis may be referred to as dynamic skip fire (DSF) control. In some embodiments, for example, the selection of an operational skip fire profile is performed on a firing opportunity by firing opportunity basis. An advantage of firing opportunity by firing opportunity control of the various components is that it makes the engine very responsive to changed inputs and/or conditions. Although firing opportunity by firing opportunity operation is very effective, it should be appreciated that the various processes can be refreshed more slowly while still providing good control (e.g., the firing fraction determinations may be performed every revolution of the crankshaft, every two or more firing opportunities, etc.).

Any of the operations described herein may be stored in a suitable computer readable medium in the form of executable computer code. The operations are carried out when a processor executes the computer code. Such operations include but are not limited to any and all operations performed by the firing fraction calculator 102, the firing timing determination module 106, the firing control unit 110, the powertrain parameter adjusting module 108, operational skip fire profile module 136, the engine controller 130, or any other module, component or controller described in this application.

Figure 6:
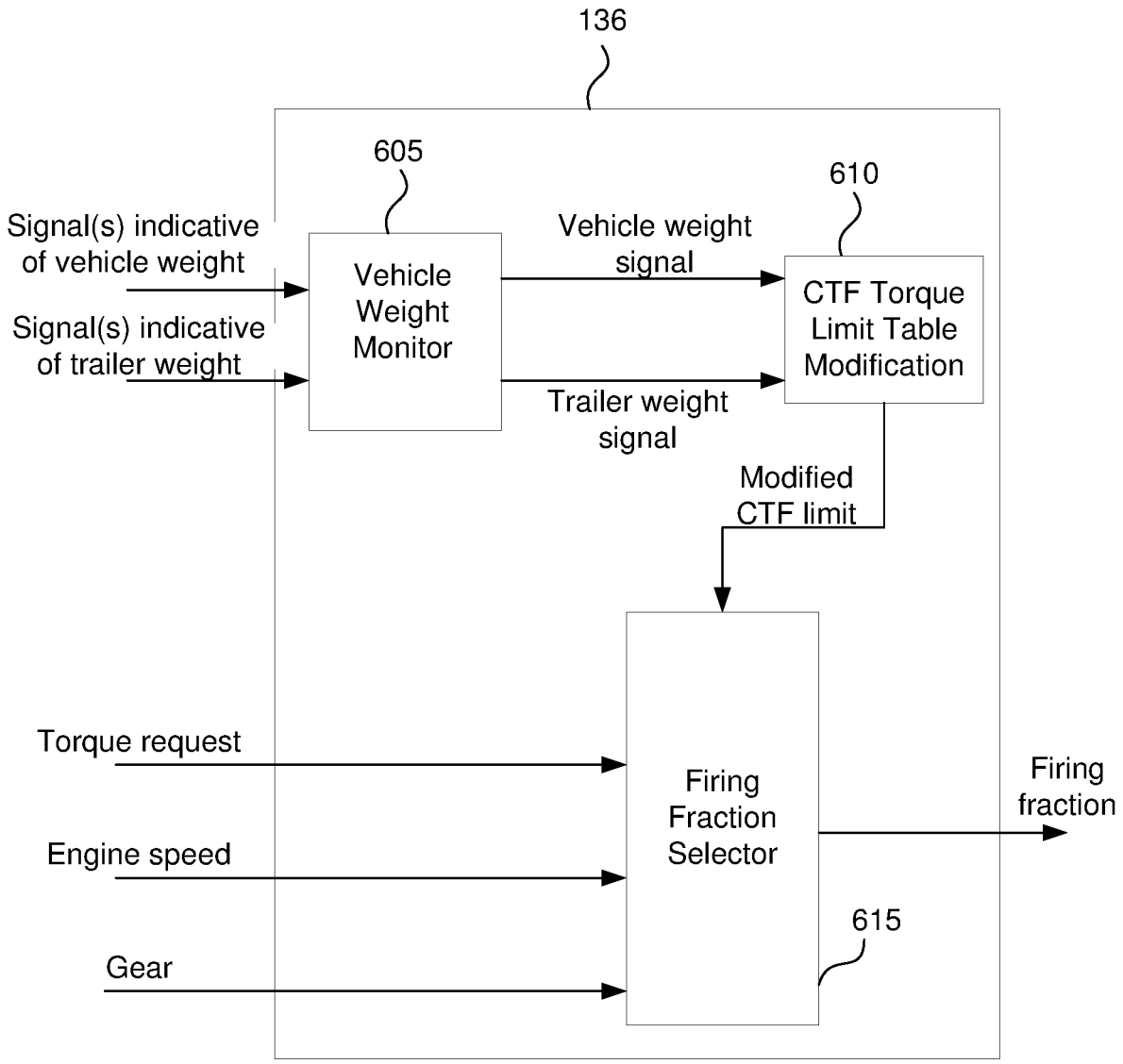
FIG. 6 illustrates an embodiment of an operational skip fire profile module which adjusts available firing fractions based on vehicle weight.

FIG. 6 illustrates an alternative embodiment of the current invention in which an apparatus to modify the operational firing fraction based on the vehicle weight or equivalently vehicle mass or vehicle load is described. In this embodiment, the CTF limits (or other torque limits) are multiplied by a factor that is a function of the sensed vehicle weight and the base unloaded weight. In general, a heavier vehicle will allow for more permissive DSF operation. In one embodiment, a vehicle weight monitor 605 detects vehicle weight based on one or more input signals The vehicle's weight can be sensed through sensors such as seat weight sensors (present for airbag and seatbelt warnings/operation) and active suspension displacement sensors. Alternatively, there may be weight sensors or monitors on each axle or tire pressure sensors on each wheel that could be used to infer vehicle weight.

Other types of sensors or combinations of sensors can be used to infer the weight of a vehicle. In one method, the weight/loading of the vehicle may be derived by measuring the torsional speed fluctuation of a rotating component in the vehicle powertrain. Examples of rotating components that are commonly measured include, but are not limited, to an engine crankshaft, a transmission input/output/intermediate shaft, a propshaft, a half-shaft or a driven wheel(s). Other rotating component speeds could be sensed directly or indirectly. An increase in the vehicle's inertia would typically lead to a reduction in the amplitude of speed fluctuations of one or more of the rotating components mentioned above. This relationship can be stored in a table or recreated using a real-time model running in the engine controller.

In a table-based embodiment, a table contains expected torsional fluctuation values for one standard vehicle weight. The actual operating weight is estimated by comparing the actual measured torsional fluctuation with the standard table value. A lower actual measurement compared to the table would indicate a higher vehicle mass and vice versa. For a given firing fraction, mean engine speed, transmission gear, and engine torque, the expected torsional fluctuation is stored. This will be a four-dimensional (4D) table or a series of three-dimensional (3D) tables. If the torsional fluctuation varies linearly with engine torque, the table can be simplified to a single 3D table or a series of two-dimensional (2D) tables.

In another look-up table-based embodiment, multiple tables are stored corresponding to multiple vehicle weights. These would be multiple 4D tables with firing fraction, mean engine speed, engine torque, and transmission gear as variables (or multiple 3D tables if engine torque can be removed as a variable). The real-time measured torsional fluctuation may then be compared against these tables and the vehicle weight is estimated by interpolating/extrapolating from the table values for different vehicle weights.

In another embodiment, the expected torsional fluctuation is calculated by a model (physical, machine learning, or some other type of model). The model result may then be compared against the real-time measured torsional fluctuation in order to estimate the operational vehicle weight.

The torsional fluctuation of a rotating component may be calculated from a high speed measurement of rotational speed. The fluctuation can be separated from mean or average speed via high pass filtering the speed signal. The high pass filtered signal may be further processed by calculating a RMS (root mean square) value of speed fluctuations within a moving window. This signal provides a metric of the level of torsional speed fluctuation. There may be different methods to process the measured rotational speed to obtain a torsional fluctuation metric. The same method to calculate the real-time fluctuation during operation may be used to populate the calibration tables of expected values or used in the real-time model.

Another method to estimate a vehicle weight or mass is through measurement of various engine and vehicle parameters and vehicle speed or acceleration. Unlike the previously described method, this method uses average or slowly moving values for vehicle speed or acceleration, rather than rapid fluctuations in these values. Generally, the power generated by operating the engine ($P_{eng}$) is used to propel the vehicle. The power generated by the engine ($P_{eng}$) may be given by the product of the engine torque (T) and engine speed (w). Torque is generally estimated and engine speed is generally measured in modern vehicles, but estimates or measurements can be used for either or both. Various formulas may be used determine the power required to propel the vehicle ($P_{veh}$). An example of such a formula is shown in Eq. 1.

$$P_{veh}=(a+b*v+c*v^2+I*\alpha+m*(a+\text{grade}*\text{gravity}))*v \quad \text{(Eq. 1)}$$

In Eq, 1 a, b, and c are constants that can be determined experimentally, or could be based on the vehicle's design, or could be estimated during operation of the vehicle. v is the vehicle velocity (speed), I is the effective rotational inertia, $\alpha$ is the angular acceleration of the engine, m is the vehicle mass, a is the linear acceleration of the vehicle, grade is the slope of surface on which the vehicle is located, and gravity is the gravitational acceleration on the vehicle. All of these quantities are generally known with the exception of the vehicle mass, which can vary greatly depending on the vehicle load as previously described.

Eq. 1 may be rearranged to solve for the vehicle mass and the engine power ($T*\omega$) may be substituted for the vehicle power to yield Eq. 2 for the vehicle's mass.

$$m=(T*\omega/v)-(a+b*v+c*v^2+I*\omega)/(a+\text{grade}*\text{gravity}) \quad \text{(Eq. 2)}$$

All of these quantities on the right side of Eq. 2 are generally known, so Eq. 2 can be solved for the vehicle mass. As noted earlier, the vehicle mass can vary greatly depending on the vehicle load. In practice, the parameters in Eq. 2 may be measured multiple times under multiple driving conditions and Eq. 2 solved multiple times. An average of these various measurements and calculations may be used as an estimate for the vehicle weight. The equation and estimates can be adjusted for losses due to friction of, among other things, transmission, differentials, or wheel bearings. The vehicle may be a single unit or may be a platform composed of multiple, mechanically linked units, such as a tractor trailer. Any of the described systems and methods for measuring or estimating a vehicle weight may be used either individually or in combination.

In some cases, an additional input may be a signal(s) indicative of trailer weight. These trailer signals may be based on the same types of sensors used to infer the vehicle weight.

Input from the various weight sensors, or other sensors and calculations used to estimate weight, may be processed and calculated in the vehicle weight monitor 605 to approximate the vehicle's weight compared to its known empty curb weight. The difference between the two weights or the ratio of the two weights can then be used as an input to a CTF torque limit table modifier 610 to adapt firing decisions for the new vehicle inertia.

In one embodiment, the vehicle weight monitor 605 generates a signal that is indicative of vehicle weight and the weight of a towed trailer (if present). These signals may be based on levels (e.g., 2, 3 or more vehicle and trailer weight levels) or may be a continuously variable signal indicative of the vehicle's/trailer's weight. A CTF Torque Limit Table Modification Module 610 may utilize the outputs of the vehicle weight monitor 605 to determine modified CTF/Torque limits based on the vehicle and trailer weight. A trailer weight signal of zero means that no trailer is attached. The modified CTF/Torque limits are used by a firing fraction selector 615 to select an operational firing fraction for the current engine operating parameters, such as a torque request, engine speed, and gear setting. Generally, as the vehicle weight increases, the allowable cylinder load will increase as the increased vehicle mass reduces the amount of engine vibration that reaches the vehicle cabin. This allows more firing fractions to have acceptable NVH characteristics as the vehicle's weight increases.

In one embodiment, the vehicle weight monitor 605, CTF/Torque Limit Modification Module 610, and Firing Fraction Selector 615 are implemented as hardware, firmware, or software within the operational skip fire profile module 136 (see FIG. 5). However, more generally one or more of these components may reside in other portions of engine controller 130.

In one embodiment, the CTF/Torque limits are modified from a base calibration. The modified CTF limits are then used to select the best firing fraction for optimal combustion and acceptable NVH given the vehicle and trailer weight levels for a given set of operating parameters, such as a torque request, engine speed, and gear.

Alternatively a discrete number of preloaded sets of CTF/Torque limit tables for various vehicle and trailer weight levels may be provided and used to adjust the CTF limit. For example, if the vehicle weight monitor has three vehicle weight output levels (e.g., light, intermediate, and heavy), then preloaded CTF limits may be provided for each level of vehicle weight.

The above calibrations may be loaded into the DSF engine controller either via lookup tables (for different weight ranges), as a real-time model based calculation, or as a simple multiplier on the baseline torque limit tables as a function of vehicle weight.

For an input with distinct levels, there are a distinct number of calibrations in terms of torque limits. This can be pre-loaded as separate tables or calculated using a multiplier corresponding to each loading level, adjusting the existing table values in real-time. For an input containing a continuous numerical value, the calculation may be an adjustment on the baseline tables based on a multiplier or function of the sensed weight.

It may be possible to update the above adjustments to the cylinder torque limits or firing fraction only when the vehicle comes to a stop, where loading or unloading of passengers and cargo may occur. The weight change on a moving vehicle may be small or slow enough that a weight-based adjustment need not be continuously updated. Making the weight-based adjustment only once during a drive cycle reduces computational load on an engine controller or other device that determines the weight-based adjustment. Adjustments in the calibration for higher or lower weights compared to a baseline weight may be either derived through measurements or through calculations.

In an alternative embodiment, slip in a disengagement element, such as a torque converter can be varied based on vehicle weight. Many vehicles deliberately use a calibrated level of slip in a torque converter to provide an acceptable level of NVH. As previously described, a heavily loaded vehicle generally experiences less NVH at a given engine operating condition than a lightly loaded vehicle. As a result, if an engine controller, such as engine controller 130, receives input indicating that a vehicle weight has increased from its empty curb weight, the amount of allowed slip in the torque converter may be reduced. This results in improved in fuel efficiency, since more of the engine rotation is transmitted to the wheels. It should be appreciated that the engine control may adjust both the operating firing fraction and torque converter slip in response to a change in the vehicle mass or it may adjust either individually. The adjustment may be based on adjustment of which powertrain operating parameter, firing fraction or slip, offers the greatest improvement in fuel efficiency. In some cases, such as vehicles with a manual transmission having a clutch, the disengagement element slip cannot be adjusted and only the firing fraction may be adjusted in response to a sensed increase in vehicle weight.

In some driving situations an engine controller 130 may receive a request for the internal combustion engine to deliver zero or negative torque, such as when decelerating or going down a hill. In this case, an engine may be operated in a deceleration cylinder cut off (DCCO) mode or a skip cylinder compression braking mode depending on the magnitude of the negative torque request. In the deceleration cylinder cut off mode, all of the engine's cylinders are deactivated. This results in little or no pumping of air through the engine and negative torque primarily arises from engine friction. This results in a relatively low level of engine braking. Operating an engine in a deceleration cylinder cut off mode has been disclosed in U.S. Pat. Nos. 9,790,867 and 10,167,799 assigned to the Applicant. An advantage of DCCO operation is that no air is pumped through the engine, which avoids flowing relatively cool air through an aftertreatment element that may be present in the exhaust system, reducing the temperature of the aftertreatment element. If adequate elevated temperatures are not maintained within the aftertreatment element, its temperature may drop such that it no longer effectively converts noxious engine emissions to more benign tailpipe emissions. In a lightly loaded vehicle DCCO may be used more often than in a heavily loaded vehicle, since less negative engine torque is required to maintain the vehicle on its desired speed trajectory. A decision whether to use DCCO or skip cylinder compression braking may thus be based at least in part on vehicle weight.

In the skip cylinder compression braking mode, selected working cycles of selected working chambers are operated in a compression release braking mode. The other working chambers may operate so that they are not fired. The not fired working cycles may be either deactivated or operate to pump air through the engine. In other words, selected working cycles of selected working chambers may be deactivated, such that their exhaust valve stays closed during selected working cycles. Still other selected working cycles of selected working chambers may open their exhaust valve during an exhaust stroke, essentially in the same manner as if the cylinder were fired, but with no fuel injection or combustion. These working cycles may be referred to as pumping working cycles. This mode of operation is described in U.S. Pat. No. 9,328,672, which is assigned to the Applicant. Alternatively, for engines equipped with a compression release or Jake brake® (a registered trademark of Jacobs Vehicle Systems, Bloomfield, Conn.) system the exhaust valve may be opened at or near the end of the compression stroke when the piston is close to its top dead center position. Opening the exhaust valve at or near the end of the compression stroke generally results in more aggressive braking as compared to opening the exhaust valve during the exhaust stroke. Skip cylinder compression braking has at least some cylinders operating as a compression release brake. Compression release braking may be referred to as retarder braking; however, retarder brakes may take other forms such as hydraulic or electrical.

Skip cylinder compression braking may be combined with wheel mounted friction brakes to slow a vehicle or control a vehicle's speed while moving downhill. If is often desirable to use skip cylinder compression braking as much as possible to minimize wear and prolong the service life of the friction brakes. The desired amount of braking can be inferred from the brake pedal position, and from this [and other inputs, such as the engine speed, vehicle weight, road grade, and other variables] a desired engine braking force can be calculated. This, in turn, may be used to derive a 'skipping fraction' which can be input to an algorithm that determines a skipping pattern. The algorithm may use a sigma delta converter, such as a first order sigma delta converter, or use a lookup table to determine a skipping pattern that provides the desired amount of braking. The skipping pattern may include cylinders operating as a compression release brake (open exhaust valve near top dead center), cylinders operating as air pumps (open exhaust valve near bottom dead center), or deactivated cylinders (exhaust valve remains closed through the working cycle). An algorithm determines the number of cylinders on average that are operating in compression release manner, i.e. the density of compression release braking working cycles. As the magnitude of the negative torque request increases the density of compression release braking working cycles increases, increasing the magnitude of the engine braking. The algorithm may use the acoustic response characteristics of the exhaust system to prevent acoustic excitations at frequencies or frequency ranges that would result in objectionable NVH. A driver also may repeatedly tap the brakes generating a signal for an increased density of compression release braking working cycles.

Figure 7:
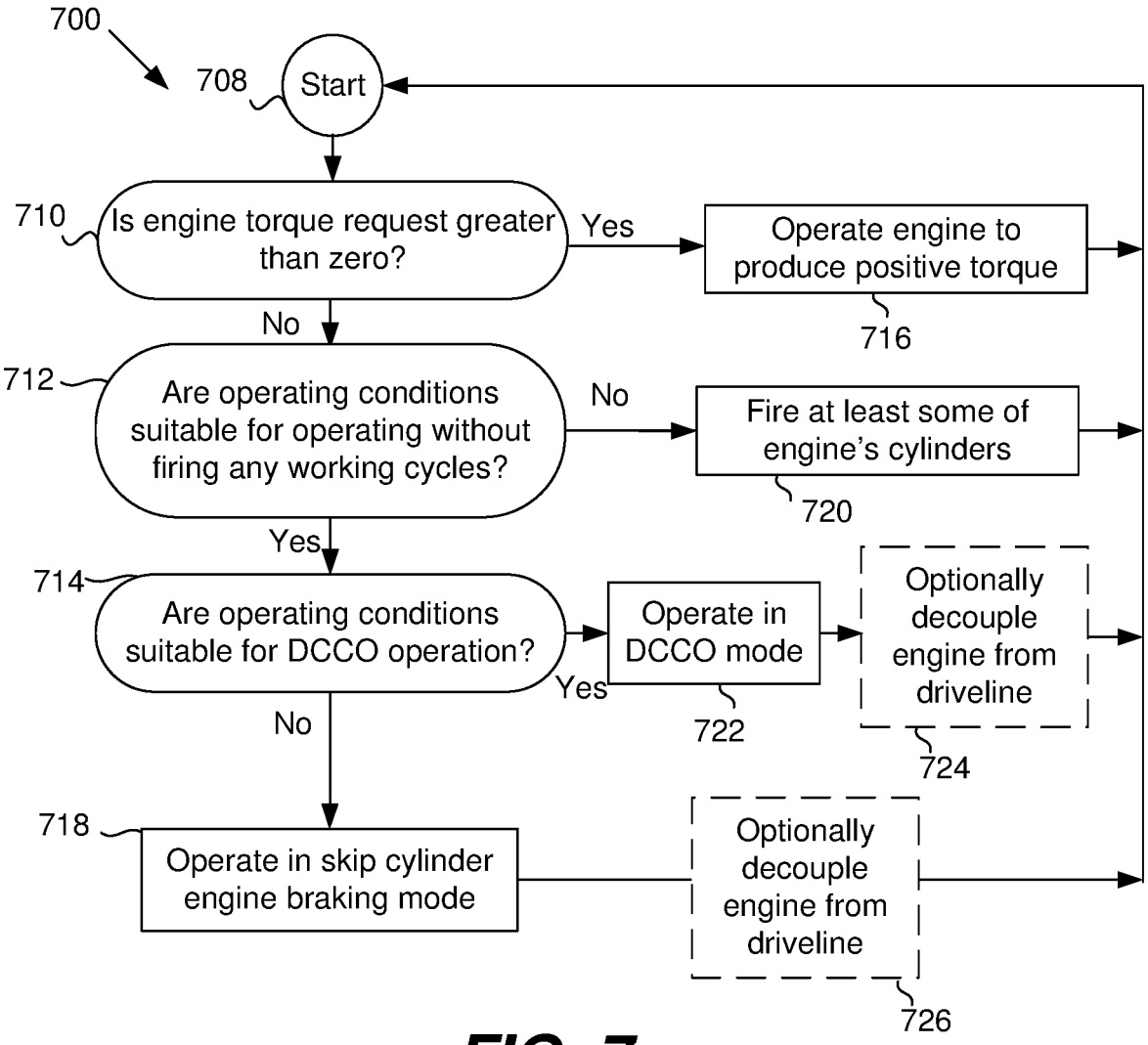
FIG. 7 illustrates a flowchart for operation in a deceleration cylinder cut off mode or skip cylinder compression braking mode according to a particular embodiment of the present invention.

Flowchart 700, shown in FIG. 7, depicts engine control logic for zero or negative engine torque requests. Flowchart 700 begins at step 708 where operation of the flowchart 700 is initiated. At step 710 a determination is made whether a positive engine torque is required to operate the vehicle. If positive torque is required, control moves to step 716, which causes the engine to operate to produce positive torque by combusting fuel in the engine. If zero or negative torque is required, control moves to step 712 where a determination is made whether it is appropriate to operate the internal combustion engine without firing any working cycles. Such modes of operation include DCCO and skip cylinder compression braking. Situation where these modes of operation may not be appropriate for zero or negative torque requests are described below. If DCCO or skip cylinder compression braking is not appropriate, control moves to step 720 where at least some of the engine's cylinders are fired. It should be appreciated that even with some cylinders firing an engine can produce negative torque if fueling levels are low. If conditions are appropriate for DCCO or skip cylinder compression braking control moves to step 714. At step 714 a determination is made whether the DCCO or skip cylinder compression braking is appropriate. If the brake pedal is not being depressed DCCO operation will likely be appropriate. If the brake pedal is depressed past a threshold level, skip cylinder compression braking will likely be appropriate. As described elsewhere, above other variables can determine the threshold level between DCCO and skip cylinder compression braking. If DCCO operation is appropriate, control moves to step 722 where the engine operates in DCCO mode. As noted in step 724 the engine may optionally be decoupled from the driveline while operating in DCCO mode. If skip cylinder compression braking is appropriate, control moves to step 718 where the engine operates in a skip cylinder braking mode. As noted in step 726 the engine may optionally be decoupled completely or partially from the driveline while operating in skip cylinder compression braking mode.

The control sequence illustrated in FIG. 7 may be executed on a firing-opportunity-by-firing-opportunity basis, although the frequency of execution may be slower such as every two firing opportunities or every engine cycle. Often the decision whether to use DCCO or skip cylinder compression braking will be based on whether a driver or autonomous controller is requesting zero or negative torque. A driver will typically make a zero torque request by removing his/her foot from both an accelerator pedal and a brake pedal that are used to control vehicle motion. Depending on the circumstances, this may result in the engine operating in a DCCO mode, in which case the engine will slowly spin down due to frictional losses, or in the engine combusting a sufficient quantity fuel to overcome frictional losses and maintaining its rotational speed, i.e. an engine at idle. In vehicles equipped with stop/start capability a zero torque request may result in the engine stopping during a drive cycle. A negative torque request will often be made by the driver depressing the brake pedal. This will result in some combination of the application of friction brakes and engine braking. A positive torque request will often be made by the driver depressing the accelerator pedal. This will result in activating at least some of the engine's cylinders so that they combust fuel and generate positive torque.

As noted above that there may be a number of no engine torque operating conditions in which it might not be desirable to go into DCCO mode. For example, in most non-hybrid engines, it is desirable to keep the crankshaft rotating at some minimum speed (e.g. at an idle speed) while the vehicle is being operated. Therefore, the engine operating rules may dictate that a DCCO mode will only be entered when the crankshaft is spinning at speeds above a designated DCCO entry engine speed threshold thereby preventing entry into the DCCO mode when the engine is operating at an idle or near idle engine speed. Similarly, in many applications it may not be possible to fully decouple the crankshaft from the driveline. Thus, the engine operating rules may dictate that the DCCO mode may not be entered when the vehicle is stopped or moving slowly—e.g., traveling a speed lower than a DCCO entry threshold vehicle speed—which may vary as a function of gear or other operating conditions. For turbocharged engines, DCCO operation may be prohibited if the turbocharger rotation rate falls below a threshold value. In another example, DCCO may be inappropriate while certain diagnostic tests are being performed. DCCO operation may also be undesirable (or specifically desirable) during certain types of traction control events, etc. It should be appreciated that these are just a few examples and there are a wide variety of circumstances in which DCCO may be deemed appropriate or inappropriate. The actual rules defining when DCCO operation is and is not appropriate can vary widely between implementations and are entirely within the discretion of the engine control designer.

In a similar manner there may be certain circumstances when vehicle braking is required, but it is not appropriate to operate in a skip cylinder compression braking mode. For example, skip cylinder compression braking may produce unacceptable NVH in some circumstances. Vehicle location may be determined automatically using an on-board global positioning system (GPS), so the engine controller can know automatically if compression release braking is allowed. For turbocharged engines, there may be a limitation on the density of deactivated working cycles to maintain a minimum turbocharger rotation rate. A mix of compression release braking working cycles and pumping working cycles may be used to maintain air flow through the engine to sustain turbocharger rotation. Thus, a pattern of compression release braking working cycles, deactivated working cycles, and pumping working cycles may be based at least in part on maintaining a turbocharger rotation rate above a threshold value.

When DCCO or skip cylinder compression braking mode is entered, there are several ways that the cylinders may be controlled. In some circumstances, each of the cylinders is deactivated in the next controllable working cycle after the decision to enter a DCCO mode is made (i.e., effective immediately). In other circumstances, it may be desirable to more gradually ramp the firing fraction down to DCCO using a skip fire approach in which some working cycles are fired and other working cycles are skipped. The skip fire ramp down approach works well when the engine is transitioning from a skip fire mode to a DCCO mode. However, it should be appreciated that the skip fire ramp down approach can also be used to facilitate transitioning to DCCO from all cylinder operation of an engine, or to DCCO from a variable displacement mode with a reduced displacement is being used (e.g., when operating using 4 of 8 cylinders, etc.).

In a similar manner when transitioning into skip cylinder compression braking mode the transition may be done gradually. For example, as an engine transitions from producing positive torque to negative torque there may be one or more engine cycles where the engine operates in a DCCO mode before some cylinders switch from being deactivated to compression release braking.

As noted above, there may be times when it is desirable to decouple the crankshaft from the transmission or other portion of the driveline. Therefore, when the DCCO mode is entered, the powertrain controller may optionally direct a torque converter clutch (TCC) or other clutch or driveline slip control mechanism to at least partially decouple the crankshaft from the transmission to reduce the coupling between vehicle speed and engine speed as represented by step 724. The extent of the decoupling that is possible will tend to vary with the specific driveline slip control mechanism(s) that is/are incorporated into the powertrain. There are a number of operating conditions where it may be desirable to mechanically decouple the engine from the driveline. For example, decoupling is desirable when the vehicle speed is zero, but the engine speed is not. During deceleration is may also be desirable to decouple the engine from the driveline, especially when a friction braking is being used. Other conditions such as transmission shifts also frequently benefit from decoupling the engine from the driveline. Gear shift status may therefore be used as a variable in determining whether it is appropriate to transition to use of DCCO or skip cylinder compression braking.

A characteristic of DCCO (deceleration cylinder cutoff) is that the engine has less resistance than it would during DFCO (deceleration fuel cutoff) due to the reduction of pumping losses. In practice, the difference is quite significant and can readily be observed when the engine is effectively disengaged from the transmission. If permitted, DFCO pumping losses would cause many engines to slow to a stop within a period on the order of a second or two at most, whereas the same engine may take 5-10 times as long to slow to a stop under DCCO (cylinder cutoff). Since DFCO arrests the engine quite quickly, it is common to keep the drive train engaged during DFCO, which means that the engine tends to slow with the vehicle and the pumping losses associated with DFCO contribute to engine braking. In contrast, when DCCO is used, the engine can be disengaged from the transmission to the extent permitted by the drive train components (e.g., a torque converter clutch (TCC), a dual-clutch transmission, etc.). In practice, this allows DCCO to be used for much longer periods than DFCO in certain operating conditions.

An advantage of using DCCO operation is that large amounts of air are not pumped through the engine, increasing an exhaust gas temperature. Diesel engines are particularly sensitive to excessive amounts of air passing through their aftertreatment system, which can lower aftertreatment element temperatures resulting in excess noxious emissions. The control logic depicted in FIG. 7 may also improve vehicle drivability by seamlessly shifting an engine between generating positive torque, zero torque, and negative torque by operator use of only the accelerator and brake pedal. This lessens the need to manually decide when minimum to moderate use of compression release braking is needed.

The engine may remain in the DCCO or skip cylinder compression braking mode until the engine controller determines that it is time to exit either of these modes. The two most common triggers for exiting tend to be either when a positive torque request is received or when the engine slows to a speed at which idle operation is deemed appropriate. Further reduction in engine speed may result in an undesired engine stall, so the engine is placed in idle operation to avoid stalling. Often, a positive torque request is caused by the accelerator pedal being depressed (sometimes referred to herein as accelerator tip-in). However, there may be a variety of other scenarios that require torque that are independent of accelerator pedal tip-in, such a control signal from a cruise control system or autonomous vehicle control system. For example, these types of scenario may occur when accessories such as an air conditioner, etc. require torque. Many vehicle air conditioners are activated by engagement of an air conditioner clutch to the vehicle powertrain, placing an additional torque load on the engine.

The acoustic response characteristics of the exhaust system are known when a vehicle or truck is assembled. Characteristics of the manufactured exhaust system may be pre-programmed into the engine controller in order to allow it to select the appropriate frequencies and frequency ranges to avoid when operating in a skip cylinder compression braking mode. If the original exhaust system is modified; for example, to add emissions control components or replace degraded components with new components that have different acoustic characteristics, the overall acoustic response of the exhaust system may be altered. In this case the original calibrations for the acoustic control algorithms may be in error, possibly resulting in unacceptable or illegal noise levels when operating in a skip cylinder braking mode.

In this case, a recalibration of the control algorithms may be done in a "training mode" that monitors acoustic characteristics under various skip cylinder compression braking conditions. This can take the form of onboard software that uses microphones existing in the vehicle cabin; for example, for handsfree phone use, voice recognition, or active noise control. It could also take the form of offboard software and microphones; for example, in the form of a software application that runs on a tester tablet or mobile phone and uses its microphone(s). By recalibrating the control algorithms, the vehicle can be made to operate at an acceptable noise level.

A certification process can be developed that satisfies mandated noise criteria. This would allow skip cylinder compression braking to be used without operator intervention. Automatic system operation would be transparent to the operator, eliminating concerns about prohibitions against use of manual compression release braking systems. This maximizes the benefits of reduction of wear and tear on friction brakes as well as reducing driver distraction.

In a manner analogous to the previously described situation where an engine is producing torque, a decision whether to enter DCCO mode or skip cylinder braking mode may be based at least in part on the vehicle weight. If the engine is operating in skip cylinder compression braking mode, the skip braking fraction or pattern may depend at least in part on the vehicle weight. For a lightly loaded vehicle a skip cylinder braking fraction or pattern will generally produce more NVH than if the vehicle is more heavily loaded. As such, more skip cylinder braking fractions or patterns will be available for use if the vehicle is more heavily loaded. Of course, the required engine torque to slow the vehicle will also be greater for a more heavily loaded vehicle.

In some embodiments, the internal combustion engine may be part of a hybrid powertrain that includes an electric motor/generator in addition to the internal combustion engine. The electric motor/generator can add or subtract torque from the powertrain. If the electric motor/generator is subtracting torque from the powertrain the energy taken from the powertrain may be stored in a battery. The stored energy may then be added back to the powertrain in the form of positive torque when desired.

The electric/motor generator may be used to subtracted torque from the powertrain instead of, or in addition to, using skip cylinder compression braking. Use of the battery to store powertrain energy depends on the battery state of charge and battery temperature. If the battery is fully charged or almost fully charged, little or no torque may be removed from the powertrain by the electric motor/generator, so skip cylinder braking must be used primarily or exclusively. Conversely, if the battery is depleted of charge, significant amounts of torque may be removed from the powertrain by the electric motor/generator, so skip cylinder braking may be used lightly or not at all. The rate of charging and discharging the battery is dependent on the battery's temperature, so this also may influence the extent to which skip cylinder compression braking is used. In a hybrid system, the engine may operate in a stop/start mode where the engine automatically turns itself off during a drive cycle when there is a request for zero or negative torque. By using the electric motor/generator to add and remove torque, the overall powertrain fuel efficiency may be improved, since torque subtracted from the powertrain by skip cylinder compression braking represents lost energy which cannot be recovered.

It should be appreciated that the engine controller 130 is not limited to the specific arrangement shown in FIGS. 5 and 6. One or more of the illustrated modules may be integrated together. Alternatively, the features of a particular module may instead be distributed among multiple modules. The engine controller may also include additional features, modules or operations based on other patents and patent applications assigned to the Applicant, including U.S. Pat. Nos. 7,954,474, 7,886,715, 7,849,835, 7,577,511, 8,099,224, 8,131,445, 8,131,447, 8,616,181, 8,701,628, 9,086,020, 9,200,575, 9,328,672, 9,739,212, 9,790,867, 9,983,583, 10,167,799, 10,247,072, 10,247,121, and U.S. patent application Ser. No. 16/576,972. Each of these patents and patent applications is incorporated herein by reference in its entirety for all purposes. Any of the features, modules and operations described in the above patents or patent applications may be added to the illustrated engine controller 130. In various alternative implementations, these functional blocks may be accomplished algorithmically using a microprocessor, engine control unit (ECU), or other computation device, using analog or digital components, using programmable logic, using combinations of the foregoing and/or in any other suitable manner.

The invention has been described primarily in the context of operating a 4-stroke, internal combustion piston engines suitable for use in motor vehicles. The internal combustion engine may be a spark ignition engine or a compression ignition engine. However, it should be appreciated that the described applications are very well suited for use in a wide variety of internal combustion engines. These include engines for virtually any type of vehicle or platform—including cars, trucks, boats, aircraft, motorcycles, scooters, locomotives, ships, aircraft etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles. The engine may be naturally aspirated or boosted with a turbocharger, supercharger, or a twin charger. In the case of a boosted engine, the maximum cylinder load may correspond to the maximum cylinder air charge obtained by boosting the air intake.

Although only a few embodiments of the invention have been described in detail, it should be appreciated that the invention may be implemented in many other forms without departing from the spirit or scope of the invention. There are several references to the term, firing fraction. It should be appreciated that a firing fraction may be conveyed or represented in a wide variety of ways. For example, the firing fraction may take the form of a firing pattern, sequence or any other firing characteristic that involves or inherently conveys the aforementioned density or percentage of firings. There are also several references to the term, "cylinder." It should be understood that the term cylinder should be understood as broadly encompassing any suitable type of working chamber. Therefore, the present embodiments should be considered illustrative and not restrictive and the invention is not to be limited to the details given herein.

What is claimed is:

1. A method of operating an internal combustion engine having a plurality of working chambers mounted to a vehicle comprising:

receiving a zero or negative torque request;

deciding whether it is appropriate to have the internal combustion engine rotate without firing any working cycles based on an aftertreatment element temperature, or a road grade; and if a zero or negative torque request is received and operation without firing any working cycles is appropriate, operating the internal combustion engine in a deceleration cylinder cut off mode in which minimal air is pumped through the internal combustion engine or a skip cylinder braking mode depending on the magnitude of the torque request, wherein selected working cycles of selected working chambers are operated in a compression release braking mode during operation in the skip cylinder braking mode.

2. The method of claim 1, wherein the vehicle weight is determined by measuring a torsional speed fluctuation of a rotating component in the vehicle powertrain.

3. The method of claim 1, wherein the internal combustion engine is a compression ignition engine or a spark ignition engine.

4. The method of claim 1, wherein if the magnitude of the torque request is zero the internal combustion engine is operated in the deceleration cylinder cut off mode.

5. The method of claim 1, wherein if the magnitude of the torque request is greater than zero the internal combustion engine is operated in the skip cylinder compression braking mode.

6. The method of claim 5, further comprising operating selected working cycles of selected working chambers with the working cycle pumping.

7. The method of claim 5, further comprising operating selected working cycles of selected working chambers with the working cycle deactivated.

8. The method of claim 5, further comprising operating selected working cycles of selected working chambers with the working cycle deactivated and other selected working cycles of selected working chambers with the working cycles pumping.

9. The method of claim 1, further determining a density of engine working cycles using compression release braking based on the magnitude of the negative torque request.

10. The method of claim 9, wherein the density of engine working cycles using compression release braking increases with the magnitude of the negative torque request.

11. The method of claim 9, wherein the density of engine working cycles using compression release braking is based at least in part on a parameter selected from a group consisting of engine speed, vehicle weight, and the presence or absence of a towed trailer.

12. The method of claim 1, further comprising determining a pattern of the selected engine compression release braking working cycles and not fired working cycles using a first order sigma delta converter or a look-up table.

13. A method of operating an internal combustion engine having a plurality of working chambers mounted to a vehicle comprising:

receiving a zero or negative torque request;

deciding whether it is appropriate to have the internal combustion engine rotate without firing any working cycles;

if a zero or negative torque request is received and operation without firing any working cycles is appropriate, operating the internal combustion engine in a deceleration cylinder cut off mode in which minimal air is pumped through the internal combustion engine or a skip cylinder braking mode depending on the magnitude of the torque request, wherein selected working cycles of selected working chambers are operated in a compression release braking mode during operation in the skip cylinder braking mode, wherein if the magnitude of the torque request is greater than zero the internal combustion engine is operated in the skip cylinder compression braking mode; and operating selected working cycles of selected working chambers with the working cycle deactivated and other selected working cycles of selected working chambers with the working cycles pumping, wherein a pattern of compression release braking working cycles, deactivated working cycles, and pumping working cycles is based at least in part on maintaining a turbocharger rotation rate above a threshold value.

14. A method of operating an internal combustion engine having a plurality of working chambers mounted to a vehicle comprising:

receiving a zero or negative torque request;

deciding whether it is appropriate to have the internal combustion engine rotate without firing any working cycles;

if a zero or negative torque request is received and operation without firing any working cycles is appropriate, operating the internal combustion engine in a deceleration cylinder cut off mode or a skip cylinder braking mode depending on the magnitude of the torque request, wherein selected working cycles of selected working chambers are operated in a compression release braking mode during operation in the skip cylinder braking mode; and determining a pattern of the selected engine compression release braking working cycles and not fired working cycles using a first order sigma delta converter or a look-up table, wherein the pattern of selected compression release braking working cycles is based at least in part on the acoustic response characteristics of the exhaust system.

15. The method of claim 14, wherein if the acoustic response characteristics of the exhaust system are modified, the vehicle undergoes a recalibration to determine patterns of the selected engine compression release braking working cycles which provides acceptable noise levels.

16. An engine controller for an internal combustion engine having a plurality of working chambers mounted to a vehicle and capable of operating either in a deceleration cylinder cut off mode or a skip cylinder braking mode, the engine controller comprising:

an operational skip fire profile module arranged to determine whether it is appropriate to have the internal combustion engine rotate without firing any working cycles, wherein if it is determined that operation without firing any working cycles is appropriate, the operational skip fire profile module uses a magnitude of a torque request to decide whether to direct the internal combustion engine to operate in a deceleration cylinder cut off mode in which minimal air is pumped through the internal combustion engine or a skip cylinder braking mode, wherein selected working cycles of selected working chambers are operated in a compression release braking mode during operation in the skip cylinder braking mode, wherein if the magnitude of the torque request is greater than zero the internal combustion engine is operated in the skip cylinder compression braking mode and wherein if the magnitude of the torque request is zero or negative the internal combustion engine is operated in the deceleration cylinder cut off mode.

17. The engine controller of claim 16, wherein the internal combustion engine is a turbocharged, compression-ignition engine.

18. The engine controller of claim 16, wherein the operational skip fire profile module receives a plurality of input signals to help determine whether operation without firing any working cycles is appropriate, wherein the input signals are selected from a group consisting of:

(a) an accelerator pedal position;
(b) a brake pedal position;
(c) an engine speed;
(d) an aftertreatment element temperature;
(e) a turbocharger rotational speed;
(f) a transmission gear setting;
(g) a regulation covering the use of compression release braking at the vehicle's current location;
(h) road grade; and
(i) a vehicle weight.

19. The engine controller of claim 18, wherein if the accelerator pedal position is not depressed and the brake pedal is not depressed the internal combustion engine operates in a deceleration cylinder cut off mode.

20. The engine controller of claim 18, wherein if the accelerator pedal position is not depressed and the brake pedal is depressed the internal combustion engine operates in a skip cylinder compression braking mode.

21. The engine controller of claim 16, wherein the operational skip fire profile module uses a first order sigma delta converter or a look-up table to determine a pattern of the selected engine compression release braking working cycles and not fired working cycles when operating in the skip cylinder compression braking mode.

22. The engine controller of claim 16, wherein the internal combustion engine is connected to a powertrain and the powertrain includes an electric motor/generator that can add or subtract torque from the powertrain by storing or removing energy from a battery.

23. The engine controller of claim 22, wherein a magnitude of the torque added or subtracted from the powertrain by the electric motor/generator is based at least in part on a state of charge of the battery or a temperature of the battery.

* * * * *